US006292573B1

(12) United States Patent
Zurek et al.

(10) Patent No.: US 6,292,573 B1
(45) Date of Patent: Sep. 18, 2001

(54) PORTABLE COMMUNICATION DEVICE WITH COLLAPSIBLE SPEAKER ENCLOSURE

(75) Inventors: Robert A. Zurek, Antioch, IL (US); Matthew White, Lake Geneva, WI (US); Thomas Stoll, Lake in the Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/409,556

(22) Filed: Sep. 30, 1999

(51) Int. Cl.[7] ..... H04R 28/00

(52) U.S. Cl. ..... 381/386; 381/387; 381/395; 381/333; 381/335; 379/428; 379/430; 379/433; 455/90; 455/100; 455/575; 455/347; 455/351

(58) Field of Search ..... 381/386, 387, 381/393, 395, 333–336; 379/428, 430, 433; 455/575, 90, 347, 351, 100

(56) References Cited

U.S. PATENT DOCUMENTS

| | | | | |
|---|---|---|---|---|
| 3,866,712 | | 2/1975 | Carruthers | 181/178 |
| 4,042,778 | | 8/1977 | Clinton | 179/1 E |
| 4,356,882 | | 11/1982 | Allen | 181/151 |
| 5,732,140 | | 3/1998 | Thayer | 381/24 |
| 5,883,966 | | 3/1999 | Kubo | 381/386 |
| 6,035,035 | * | 3/2000 | Firooz . | |
| 6,192,253 | * | 10/1999 | Charlier . | |

* cited by examiner

*Primary Examiner*—Curtis Kuntz
*Assistant Examiner*—Dionne N. Harvey
(74) *Attorney, Agent, or Firm*—Brian M. Mancini

(57) ABSTRACT

A portable communication device includes a speaker enclosure having a speaker and a plurality of telescoping nested shells moveable between a collapsed configuration and an expanded configuration. The shells have a top and bottom surface and interlocking sidewalls such that when the enclosure is deployed into an expanded configuration the shells form a rigid enclosure with a substantially sealed acoustic space therein. The space tunes an acoustic compliance for the speaker so as to improve broadband frequency response whether the communication device is using a privacy or speakerphone mode of operation.

14 Claims, 3 Drawing Sheets

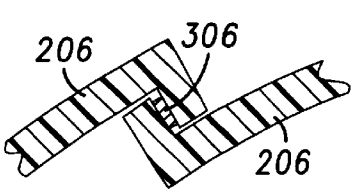
FIG.5
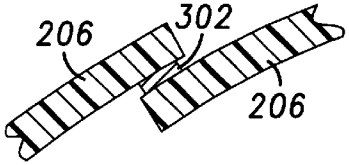
FIG.6
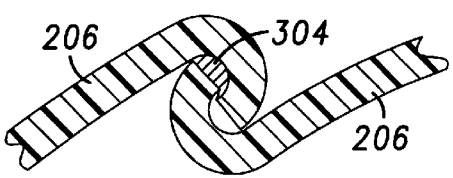
FIG.7
FIG.8
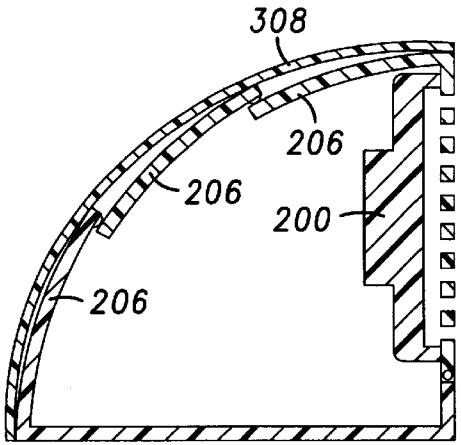
FIG.9
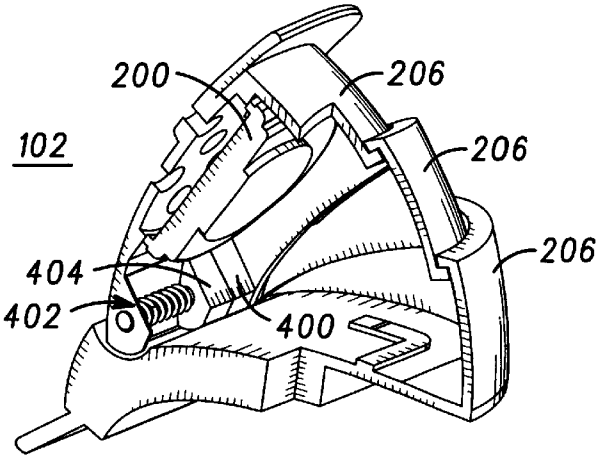
FIG.10

PORTABLE COMMUNICATION DEVICE WITH COLLAPSIBLE SPEAKER ENCLOSURE

FIELD OF THE INVENTION

This invention relates generally to portable communication devices and more specifically to speaker configurations of a portable communication device.

BACKGROUND OF THE INVENTION

With the widespread popularity of portable communication devices such as cellular telephones, there has been an increasing demand for such portable communication devices to operate in more than one user mode. In a first mode of operation, here referred to as a normal-phone mode or private mode, a user first holds the portable communication device away from his ear and enters access information such as a telephone number. The input data can be verified by monitoring the information shown on a display. The user then places the portable communication device close to his ear to engage in a call.

The first mode of operation limits usability; it is sometimes desirable for the user to not have to hold the portable communication device while engaged in a call. For these reasons, a second mode of operation, a hands-free or speakerphone mode, is employed.

In the speaker phone mode, the portable communication device will emit audio information at a louder volume, thus allowing the user to hear information while the portable communication device is away from his ear. However, the continued reduction in size of portable communication devices prohibits the use of conventional acoustic cavity designs otherwise found in speakerphone systems. There, a speaker configuration is needed to provide improved speaker performance in a small packaging envelope.

Devices have been used to linearly protrude a speaker from an available housing. However, these devices can not be used when the housing size is too small, such as in a wristphone.

In addition, when the portable communication device is in the speakerphone mode while it is close to the user's ear, acoustic shock to the user's hearing system could result. Therefore, a highly reliable mode switching system is needed to switch the phone between the normal-phone mode and the speakerphone mode of operation.

Proximity detector systems have been used to switch a portable communication device between the private mode and the speakerphone mode. These systems depend on having the phone near the users head. However, these would not work on a handsfree phone or a small device such as a wristphone.

Hinged or clam-shell type phones have developed a system where the position of the hinge directs whether the phone operates in private mode or the speakerphone mode. However, this system would not work on a one-piece phone, or other non-hinged phones such as a wristphone.

Other limitations of prior art wristphones are the upper limits placed on the achievable acoustical quality and loudness. As portable communication devices such as wristphones become smaller and thinner, space necessary for acoustical baffling, resonance, and isolation between the front and the back sides of the speaker diminishes. In addition, the speakers themselves get smaller. Voice quality is thus degraded. And although the speaker performance may be adequate for privacy mode conversation, speaker performance is not adequate for speaker phone operation.

Accordingly, there is a need for a portable communication device with a speaker enclosure that provides improved speakerphone performance as well as privacy mode performance. In addition, there is a need for a speaker enclosure that can be used to select between privacy and speakerphone operation. There is a further need for improved acoustics for better sound quality during speakerphone mode. In addition, there is a need for portable communication device that is configured as a wristphone with a speaker enclosure that provides a speakerphone mode.

BRIEF DESCRIPTION OF THE DRAWINGS

FIG. 5 shows a first seal type for a speaker enclosure, in accordance with the present invention;

FIG. 6 shows a second seal type for a speaker enclosure, in accordance with the present invention;

FIG. 7 shows a third seal type for a speaker enclosure, in accordance with the present invention;

FIG. 8 shows a fourth seal type for a speaker enclosure, in accordance with the present invention;

FIG. 9 shows a fifth seal type for a speaker enclosure, in accordance with the present invention;

FIG. 10 shows a detailed perspective view of the speaker enclosure of FIG. 4;

DETAILED DESCRIPTION OF THE PREFERRED EMBODIMENTS

Figure 3:
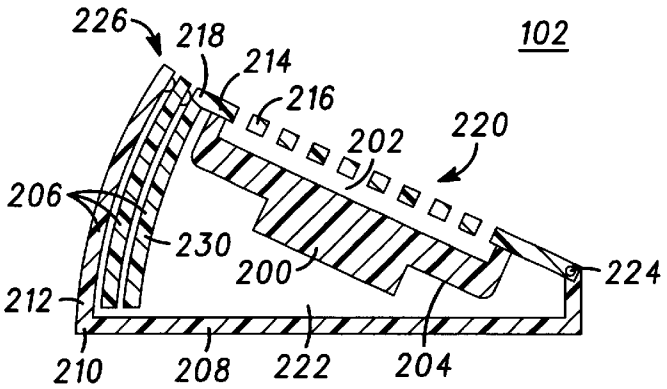
FIG. 3 shows a cross-sectional view of the speaker enclosure of FIG. 1.

The present invention provides improved speakerphone performance as well as privacy mode performance in a portable communication device, by improving acoustics for better sound quality. In particular, the present invention includes an adjustable speaker enclosure that can be used to select between privacy and speakerphone operation. In addition, the present invention provides a speaker enclosure for a miniature portable communication device that does not have an electronics housing of a sufficient size to provide a necessary acoustic cavity. The configuration for the present invention includes a speaker enclosure carried separately from the radiotelephone circuitry housing. In a wristphone, for example, the speaker enclosure is located on or within a wristband of the device such that the wristphone is less bulky, can be worn easily, and has an aesthetic appearance.

While the specification concludes with claims defining the features of the invention that are regarded as novel, it is believed that the invention will be better understood from a consideration of the following description in conjunction with the drawing figures, in which like reference numerals are carried forward. A radiotelephone is a device that communicates information using electromagnetic waves in the radio frequency range, as is known in the art. The radiotelephone portion of the portable communication device is preferably a cellular radiotelephone adapted for personal communication or personal computing, but may also be a cordless radiotelephone or a personal communication service (PCS) radiotelephone. The radiotelephone portion may be constructed in accordance with an analog communication standard or a digital communication standard. The radiotelephone portion generally includes a radio frequency (RF) transmitter, a RF receiver, a controller, an antenna, batteries, a duplex filter, a frequency synthesizer, a signal processor, and a user interface including at least one of a keypad, control switches, a display, and a microphone. The radiotelephone portion can also include a paging receiver. If the device incorporates a pager, there might be a small liquid crystal display and a separate audio annunciator. The electronics incorporated into a watch, or for that matter, a portable cellular phone, two-way radio or selective radio receiver, such as a pager, are well known in the art, and may be incorporated into the present invention.

The present invention includes a rigid, collapsible speaker enclosure that allows the reproduction of a broadband acoustic response, while fitting in a low profile form factor. The enclosure is divided into a series of rigid segments or shells that when expanded, interlock to form one or more acoustic cavities used in the tuning of the speaker system.

Figure 1:
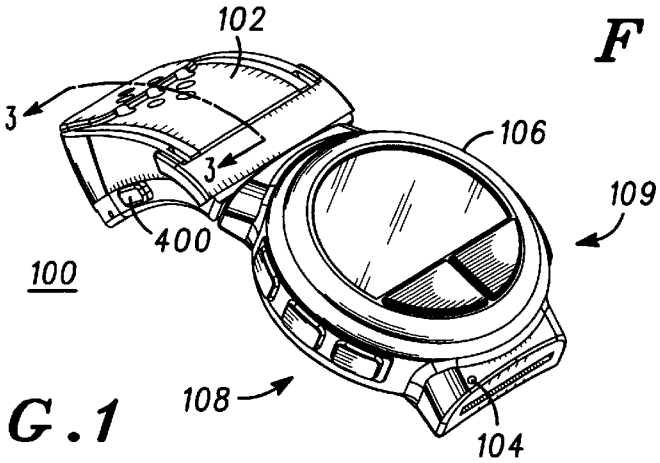
FIG. 1 shows a perspective view of a portable communication device with a speaker enclosure in a collapsed position, in accordance with a preferred embodiment of the present invention.
Figure 2:
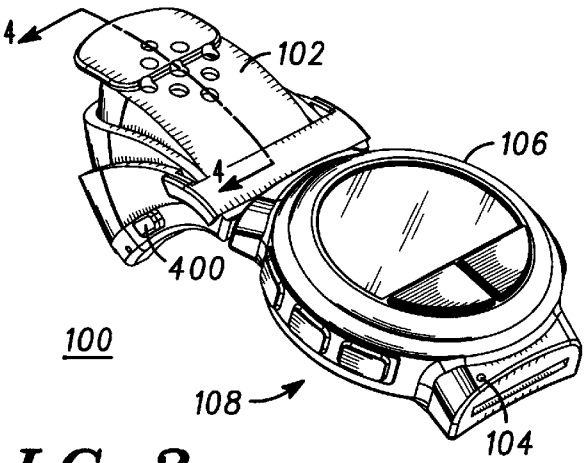
FIG. 2 shows a perspective view of a portable communication device with a speaker enclosure in an expanded position, in accordance with a preferred embodiment of the present invention.

FIGS. 1 and 2 illustrate a portable communication device 100, here represented by a portion of a wristphone, with a speaker enclosure 102 that is capable of being operated in a privacy mode and a speakerphone mode. FIG. 1 shows the enclosure 102 being collapsed and FIG. 2 shows the enclosure 102 being expanded. When closed, the shells collapse into each other, and the speaker nests inside of the shell walls. When open, details are designed into the shells to limit the amount the shells open to. These details cause the enclosure to open to the same volume every time the enclosure is deployed. This enlarged volume is used as an acoustic compliance. Rigid walls are used because the purpose of the acoustic enclosure is to provide a compliant element in the acoustic system. If the walls were flexible, the air in the enclosure would not compress and act as a stiffness. Instead the combination of the enclosed air and the flexible walls would act as a large mass added to the speaker diaphragm. This mass would severely attenuate the acoustic output of the system.

Preferably, the communication device 100 provides two-way voice communication and can also include data transfer functions such as internet connectivity, email, and FAX capability. A microphone 104 is included within the radiotelephone housing 106 to facilitate two-way communication. The speaker enclosure 102, although shown adjacent to the housing 106, can be located anywhere along the watchband. The enclosure 102 could also be located within the housing 106, although this is not preferred as it would result in a much too bulky configuration.

The communication device 100 includes a user interface 108 that directs user input data to a controller of the communication device. Typically, the user interface 108 includes at least one of a microphone 104, a display, a keypad, and special function input elements. The controller typically includes a microprocessor, memory, a clock generator, and digital logic. The controller controls the radio communication of the device 100. The user interface 108 also includes an activation element, responsive to a user input, for producing an activation signal to the controller.

In a preferred embodiment, the speaker enclosure 102 includes a switch that continuously detects the physical configuration of the speaker enclosure 102. The switch sends a position signal to the controller (represented as 109 in FIG. 1). The controller operates the communication device 100 in any of a private-mode, a speakerphone mode, and a standby mode in response to the position signal and the activation signal. When the communication device 100 is active and the speaker enclosure is collapsed, the switch directs the controller to operate the communication device 100 in a privacy mode. When the communication device 100 is active and the speaker enclosure is expanded, the switch directs the controller to operate the communication device 100 in a speakerphone mode. Alternatively, when the communication device 100 is active and the speaker enclosure is collapsed, the switch directs the controller to operate the speaker as an alert in a standby mode. When the communication device 100 is active and the speaker enclosure is expanded, the switch directs the controller to operate the communication device 100 in a speaker mode (privacy or speakerphone). The user could then select manually whether to operate the communication device with the expanded speaker enclosure in privacy mode or speakerphone mode.

Optionally, the user can control operating mode independently from the user interface 108. For example, a user could select between handsfree (speakerphone) operation and private operation by entering predetermined key sequences, by entering a menu to select between them, or by any other suitable means. A message such as "handsfree" or "private" may be entered in a display, or aural and/or visual indicators may inform the user whether handsfree operation or private operation has been selected.

FIG. 3 illustrates a cross section view of the speaker enclosure in a collapsed, privacy mode configuration. The speaker enclosure 102 includes a speaker 200 having a first speaker side 202 and a second speaker side 204. A plurality of telescoping nested shells 206 are mounted on a rigid portion of the communication device. The outermost nested shell includes a surface conjoining a bottom edge 210 of a side wall 212 of the outermost nested shell defining a rigid base. A first shell 214 of the plurality of shells having a surface 216 conjoining a top edge 218 of the side wall 206 of the first shell 214. The surface 216 includes an acoustic baffle 220 with holes therethrough for transmitting audio signals from the speaker 200. The speaker 200 is mounted to the surface 216 to abut one side of the acoustic baffle 220 with the first speaker side 202 facing the acoustic baffle 220.

The shells 206 are shown in a fully collapsed configuration although operation in a semi-collapsed state is possible. The shells 206 have interlocking rigid side walls 206 such that the second speaker side 204, the side walls 206, and the base define a rigid enclosure with at least one substantially sealed acoustic space 222 therein. Although three shells are shown, it should be recognized that two or more shells can be used equally well in the present invention.

Figure 4:
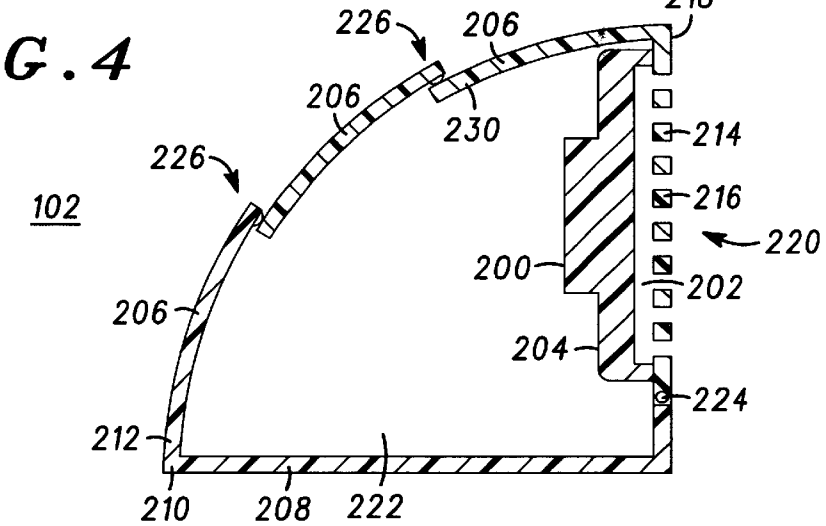
FIG. 4 shows a cross-sectional view of the speaker enclosure of FIG. 2.

As shown in FIG. 4, when the enclosure 102 is deployed into an expanded, speakerphone configuration the shells form a rigid enclosure with at least one substantially sealed acoustic space 222 therein that is larger than the sealed space in the collapsed configuration. The at least one space 222 tunes an acoustic compliance for the speaker 200 so as to improve broadband frequency response in the expanded configuration.

Although the shells, as shown in FIGS. 3 and 4 for a wristphone, for example, are pivotally hinged near corresponding edges along a common axis 224 to provide a low profile, the present invention contemplates other nested shell configurations including conical sections that expand linearly, rotatable sections that expand helically, and the like.

When providing rigid sections it is important to provide a sealing device therebetween to prevent leaks. The speaker enclosure 102 provides a substantially sealed cavity 222 by having the plurality of shells include an acoustic sealing apparatus 226 therebetween. The sealing apparatus 226 provides a seal around adjacent edges of the walls 206 between shells. Although it is preferred that the enclosure is sealed whether open or closed, it is not necessary that the sealing apparatus provide a seal in the closed configuration.

FIGS. 5–9 shows cross-sectional views of various different types of sealing apparatus. FIG. 5 includes an elastic o-ring 300 between shells. The o-ring surrounds the side walls of a shell to provide a substantially complete seal between shells. FIG. 6 shows the simplest sealing apparatus that provides an interference fit between shells. This can be accomplished in two ways. The first way incorporates a coating 302 on one or both of adjacent shells. The coating 302 extends around the side walls of a shell to provide a substantially complete seal between shells. The second way provides a taper to the dimension of the side walls or an conical-like extension to the side wall relative to the hinge, wherein the shells have a slip fit when collapsed and an interference fit when expanded. This can be accomplished with or without a coating 302, such as a Teflon™ coating.

FIGS. 7 and 8 show a sealing apparatus comprising interlocking extrusions. FIG. 7 shows a J-shaped extrusion that runs around an edge of one side wall that interlocks with another J-shaped extrusion that runs around an edge of an adjacent side wall. FIG. 8 shows an L-shaped extrusion similar to the J-shaped extrusion of FIG. 7. In both types (FIGS. 7 and 8), one or both of the extrusions can include an elastic coating 304,306 therebetween to further enhance sealing. FIG. 9 shows another sealing apparatus including an elastic boot 308 enclosing the sidewalls of the shells. The boot 308 being operable to acoustically seal the enclosure formed by the plurality of shells 206. The elastic boot 308 could also be used in combination with the other sealing devices described above to further improve sealing of the speaker enclosure.

FIG. 10 shows a preferred embodiment of the speaker enclosure. This embodiment includes a latch 400 operable to retain the shells 206 in a collapsed configuration and a spring 402 operable to deploy the shells 206 in an expanded configuration when released from the latch 400. The latch 400 is user operable and, when released, allows the spring to automatically expand the speaker enclosure. The user collapses the enclosure manually until its is latched again. It should be recognized that other spring assemblies could also be used successfully, such as a leaf spring or a coil spring attached to the back of the speaker.

More preferably, a switch 404 is included for detecting a position of the shells. The switch is mechanically coupled to the enclosure and electrically coupled to a controller carried in the communication device housing 106. The controller operates the portable communication device in one of a standby mode, a speakerphone mode, and a private mode in response to the switch and an activation signal. The switch 404 operates to signal the communication device to change from a privacy mode of operation to a speakerphone mode of operation when the enclosure is in the expanded configuration and the communication device is active. The switch 404 is operable to signal the communication device to change from a speakerphone mode of operation to a privacy mode of operation when the enclosure is in the collapsed configuration and the communication device is active. When the communication device is not active it is in standby mode whether the enclosure is collapsed or expanded.

Also in a preferred embodiment, as shown in FIG. 4, the first shell is the innermost nested shell 230 such that the enclosure encompasses a single substantially sealed space 222 behind the second speaker side 204 to form the sealed substantially sealed space 222. The second speaker side 204 and shells 206 define an acoustic suspension enclosure where the internal air cavity behind the speaker is acoustically sealed from the front of speaker. In particular, the enclosure when collapsed encompasses a space that is one-half or less than that space when the enclosure is expanded.

Figure 12:
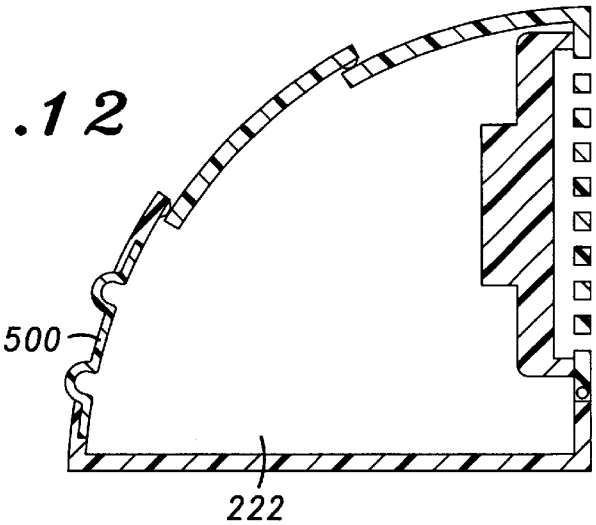
FIG. 12 shows an expanded configuration for a second embodiment of a speaker enclosure, in accordance with the present invention.
Figure 11:
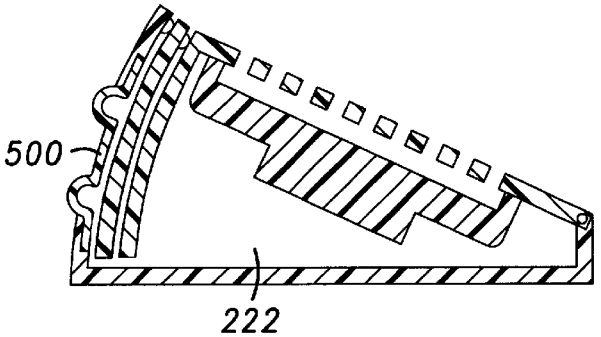
FIG. 11 shows a collapsed configuration for a second embodiment of a speaker enclosure, in accordance with the present invention.

In an alternatively embodiment, one of the shells can include a passive radiator 500 as shown in FIGS. 11 and 12. The passive radiator 500 is acoustically coupled to the at least one space 222 when the enclosure is in the expanded configuration so as to provide improved low-frequency response appropriate to that of a vented enclosure, such as a bass-reflex or ported speaker enclosure, for example. The passive radiator, speaker, and cavity are tuned in such a way as to increase the low frequency extension of the system below the speaker's resonant frequency. The passive radiator could be eliminated to provide an open tuned port, but has the advantage of providing waterproof operation. In this instance a passive radiator is used whose moving mass is equivalent to the port it replaces. It should be recognized that the vented or sealed configurations described above can be used for both speaker and alert operation. For example, the system would be used for loudspeaker operation when fully deployed and for alert operation when closed. Alert tones are produced at a higher frequency than speech information. Collapsing the enclosure shifts the system resonance above the speech band but still below the alert band. Alternatively, with proper tuning, the system can be used in speakerphone mode when expanded and privacy or alert mode when collapsed.

Figure 14:
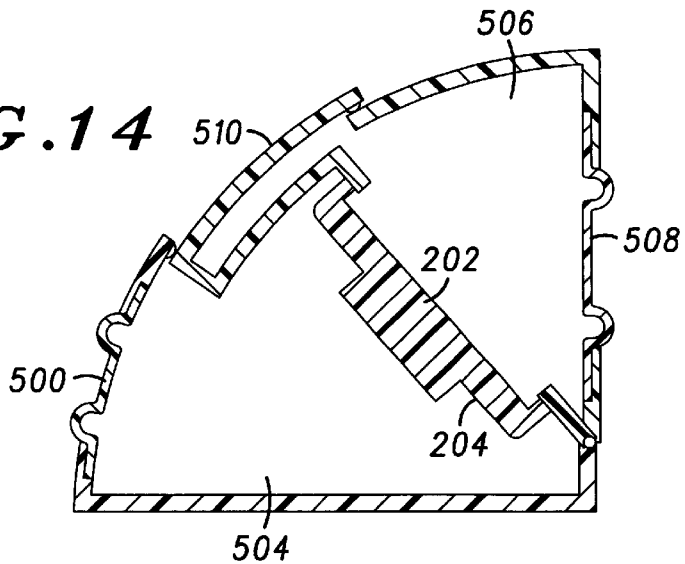
FIG. 14 shows an expanded configuration for a third embodiment of a speaker enclosure, in accordance with the present invention.
Figure 13:
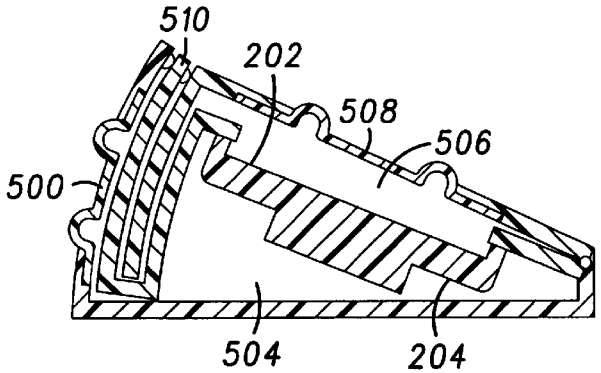
FIG. 13 shows a collapsed configuration for a third embodiment of a speaker enclosure, in accordance with the present invention.

In another alternate embodiment as shown in FIGS. 13 and 14, the first shell is one of the middle nested shells 510 such that the enclosure encompasses a second substantially sealed space 504 behind the second speaker side 204 and a first substantially sealed space 506 in front of the first speaker side 202 so as to provide an acoustic bandpass system to improve efficiency at the expense of bandwidth. More preferably, at least one of the shells includes a passive radiator 500, 508 acoustically coupled to at least one of the first and second spaces 504, 506 so as to provide improved low-frequency response appropriate to that of a vented bandpass enclosure, such as a bass-reflex or ported bandpass speaker enclosure, for example. In this instance, passive radiator 500 is only operable when the enclosure is in an expanded configuration, while passive radiator 508 is always operable. However, the two cavities can also be ported to each other or sealed, as long as one of the cavities is ported to the outside of the system. The remaining porting is based on the order of the bandpass desired. FIGS. 13 and 14 show a system that has both the cavities ported to the outside air through passive radiators. The speaker magnet can face either way and be on either side of the baffle of the first shell.

In operation, the portable communication device includes an electronics housing element that carries special function input elements. These elements are usable for increasing the volume of audio signals, decreasing the volume of audio signals, scrolling through menus and information, initiating different menus, an activation element, and an optional switch used for privacy/speakerphone mode.

To switch operation of the radiotelephone from private mode to speakerphone mode, the user must first toggle the activation element and then open the speaker enclosure. The controller monitors how much time has elapsed between toggling the activation element and when the speaker enclosure is indicated as expanded, by the switch.

To switch operation from private mode to speakerphone mode, the speaker enclosure must be set to the substantially expanded position within a first predetermined period of time after the activation element has been toggled. In the illustrated embodiment, the first predetermined period of time is four seconds. The controller continuously monitors the position of the switch to determining whether to switch the operation of the phone. Therefore, when the radiotelephone is in privacy mode and the activation element is toggled, the controller begins to monitor elapsed time. If the speaker enclosure is not set to the substantially expanded position within the first predetermined period of time, the radiotelephone will continue operation in the privacy mode.

The switch can comprise a magnet located in the housing, a Reed switch located in enclosure shells, and circuitry coupled to the Reed switch to develop the position signal. Alternatively, the hinge that movably connects the shells can contain the switch in the form of a rotary switch coupled to controller.

If the activation element is toggled during privacy mode operation and the speaker enclosure is set to the expanded position, but not within the first predetermined period of time, the controller will begin to monitor time anew, starting from the time when the speaker enclosure was expanded. If the user does not move the speaker enclosure back to the substantially collapsed position within a second predetermined period of time, the controller will end the telephone call and operate the radiotelephone in the standby mode. In the illustrated embodiment, the second predetermined period of time is four seconds. If, however, the user does move the speaker enclosure back to the substantially collapsed position within the second period of time, this indicates that the user did not mean to end the telephone call, and the controller will continue to operate the radiotelephone in the privacy mode. In addition, if the user has not toggled the activation element and sets the speaker enclosure to the substantially expanded position, the controller ends the telephone call and operates the radiotelephone in the standby mode.

Another way to switch operation from private mode to speakerphone mode is for the user to hold the activation element toggled while the speaker enclosure is set to the substantially expanded position. In the preferred embodiment the activation element is a button. Thus, to switch operation from private mode to speakerphone mode, the user can hold the activation element pressed while releasing the latch so that the speaker enclosure deploys to the substantially expanded position. For this implementation, timers are not necessary.

The user can also switch the operation of the radiotelephone from the standby mode to the speakerphone mode. For example, while the radiotelephone is in the standby mode with the speaker enclosure in the substantially expanded position, the user can toggle the activation element and switch operation to the speakerphone mode. Voice recognition circuitry then allows the user to dial a telephone number and activate a telephone call with the speaker enclosure remaining in the substantially expanded position.

Alternatively, if the radiotelephone is in the standby mode and rings to indicate an incoming call, a user can answer the call by leaving the speaker enclosure in the substantially expanded position and toggling the activation element. The controller will then activate the radiotelephone to answer the call and operate the radiotelephone in the speakerphone mode. Moving the speaker enclosure to the substantially collapsed position immediately causes the controller to operate the radiotelephone in the private mode. It will be obvious to those skilled in the art that other combinations of the activation element and the setting of the speaker enclosure can be used to operate the radiotelephone in private mode, speakerphone mode, and standby mode.

In the speakerphone mode, the gain of the audio circuitry driving the speaker is increased substantially (compared to the gain of the audio circuitry when the phone is operating in the private mode) so that the user can hear the speaker output even though the radiotelephone is not immediately adjacent to the user's ear. When audio signals are not present at the single speaker, the gain of the circuitry coupled to the microphone is increased substantially (relative to the private mode gain setting) in order to increase the sensitivity of the microphone. When audio signals are present at the speaker, the gain of the circuitry coupled to the microphone is then decreased again in order to reduce speaker-to-microphone feedback. The gain of the circuitry coupled to the microphone is only decreased during periods when high audio peaks are present at the speaker rather than the entire time when audio signals are present at the speaker.

When the radiotelephone is operating in the speakerphone mode and the user collapses the speaker enclosure (FIG. 1), the controller will switch operation to the privacy mode. When the operation of the portable communication device is changed from speakerphone mode to privacy mode, the gain of the circuitry driving the speaker and the microphone is decreased substantially from the speakerphone gain setting.

The radiotelephone can operate in the standby mode when the speaker enclosure is in the substantially expanded position and the substantially collapsed position. The standby mode is a mode in which certain circuitry is powered down to save energy, while other circuitry remains active in order to receive incoming calls. The position of the speaker enclosure affects operability only when the communication device is active.

In practice a felt material is attached to the inside of the baffle and is located between the baffles and the speaker. The felt material serves as an acoustical resistor and prevents foreign material from entering the speaker enclosure. Also, felt material can be applied to the enclosure's inner walls to dampen acoustic transmission through the enclosure walls, thereby enhancing privacy.

The mode-switchable enclosure has a significant advantage over a speaker enclosure of conventional radiotelephone. Expanding the speaker enclosure while pressing an activation element button or after toggling the activation element for the speakerphone mode of operation helps prevent the user from placing the communication device close to his ear during the speakerphone mode. Furthermore, the expanded and collapsed form factor of the speaker enclosure is yet another visual indication to the user as to whether the communication device is in speakerphone mode and to not place the radiotelephone close to his ear during speakerphone operation. Thus, the likelihood of accidental acoustic shock to the user's ear is greatly reduced. Utilizing a single speaker for both privacy mode and speakerphone mode operation reduces radiotelephone manufacturing cost and decreases the size of the radiotelephone, which are both highly desirable characteristics.

The acoustic coupling and compliance of the expandable speaker enclosure significantly improves sound quality during operation. A speaker having a relatively high compliance can be used for both private operation and for handsfree operation when the speaker and its enclosure, as an assembly are acoustically tuned, as illustrated in the above embodiments so that the low frequency response is substantially improved. The high effective air volume of a high compliance speaker is compensated by acoustically coupling to the air volume of the expanded configuration of the speaker enclosure. Acoustic tuning can be adjusted by providing one of a sealed or vented enclosure. Examples of these are an acoustic suspension (sealed) configuration, bass-reflex (vented) and ported (vented) configuration. In addition, further acoustic tuning can be had by adjusting the order (i.e. $2^{nd}$, $4^{th}$, $6^{th}$ order, etc.) of the of the configuration or providing various filter configurations (e.g. bandpass).

Preferably, the acoustic compliance of both the expanded and collapsed configurations of the present invention are tuned to provide optimal output for loudspeaker operation in the expanded state and alert operation in the collapsed state. More preferably, the acoustic compliance of the collapsed configuration is tuned to provide optimal output when coupled to a user's ear.

It is to be understood that the preferred speaker being used is a dynamic speaker including a diaphragm, voice coil, and magnetic motor assembly, as is known in the art. It is understood that the speaker can be replaced by a piezoelectric speaker, as is also know in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. A portable communication device including a speaker enclosure comprising:

a speaker having a first speaker side and a second speaker side;

a plurality of telescoping nested shells mounted on a rigid portion of the communication device, the shells moveable between a collapsed configuration and an expanded configuration, the shells having interlocking rigid side walls such that when the enclosure is deployed into an expanded configuration the shells form a rigid enclosure with at least one substantially sealed acoustic space therein, the at least one space tunes an acoustic compliance for the speaker so as to improve broadband frequency response in an expanded configuration;

a middle shell of the plurality of nested shells having a surface including an acoustic baffle for transmitting audio signals from the speaker, the speaker being mounted on the surface to abut one side of the acoustic baffle with the first speaker side facing the acoustic baffle such that the enclosure encompasses a second substantially sealed space behind the second speaker side and a first substantially sealed space in front of the first speaker side so as to provide an acoustic bandpass system to improve efficiency.

2. The portable communication device of claim 1, wherein at least one of the shells includes a passive radiator acoustically coupled to at least one of the first and second spaces so as to provide improved low-frequency response appropriate to that of a bass-reflex or ported bandpass speaker enclosure.

3. A portable communication device including a speaker enclosure comprising:

a speaker having a first speaker side and a second speaker side;

a plurality of telescoping nested shells mounted on a rigid portion of the communication device, the shells moveable between a collapsed configuration and an expanded configuration, the shells having interlocking rigid side walls such that when the enclosure is deployed into an expanded configuration the shells form a rigid enclosure with at least one substantially sealed acoustic space therein, the at least one space tunes an acoustic compliance for the speaker so as to improve broadband frequency response in an expanded configuration;

a first shell of the plurality of nested shells having a surface conjoining a top edge of the side walls, the surface including an acoustic baffle with holes therethrough for transmitting audio signals from the speaker, the speaker being mounted on the surface to abut one side of the acoustic baffle with the first speaker side facing the acoustic baffle; and wherein one of the shells of the plurality of nested shells includes a passive radiator acoustically coupled to the at least one space so as to provide improved low-frequency response appropriate to that of a bass-reflex or ported speaker enclosure when the enclosure is in the expanded configuration.

4. The portable communication device of claim 3, further comprising:

a latch operable to retain the shells in a collapsed configuration; and a spring operable to deploy the shells in an expanded configuration when released from the latch.

5. The portable communication device of claim 3, further comprising a switch for detecting a position of the shells, the switch being mechanically coupled to the enclosure and electrically coupled to a controller carried in the communication device, the controller for operating the portable communication device in one of a standby mode, a speakerphone mode, and a private mode in response to the switch and an activation signal, the switch being operable to signal the communication device to change from a privacy mode of operation to a speakerphone mode of operation when the enclosure is in the expanded configuration and the communication device is active, the switch being operable to signal the communication device to change from a speakerphone mode of operation to a privacy mode of operation when the enclosure is in the collapsed configuration and the communication device is active.

6. The portable communication device of claim 3, further comprising a switch for detecting a position of the shells, the switch being mechanically coupled to the enclosure and electrically coupled to a controller carried in the communication device, the controller for operating the portable communication device in one of a standby mode and a speaker mode in response to the switch, the switch being operable to signal the communication device to change from a standby mode of operation to a speaker mode of operation when the enclosure is in the expanded configuration and the communication device is active, the switch being operable to signal the communication device to change from a speaker mode of operation to a standby mode of operation when the enclosure is in the collapsed configuration wherein the speaker is used as an alert.

7. The portable communication device of claim 3, wherein the plurality of shells are pivotally hinged near corresponding edges around a common axis.

8. The portable communication device of claim 3, further comprising an acoustic sealing apparatus, the sealing apparatus located between the shells and providing a seal around adjacent edges of the walls between shells.

9. The portable communication device of claim 8, wherein the sealing apparatus includes at least one of an elastic o-ring, a Teflon™ coating, interlocking extrusions including an elastic coating, and an interference fit between the shells.

10. The portable communication device of claim 3, further comprising an elastic boot enclosing the walls of the shells, the boot being operable to acoustically seal the enclosure formed by the plurality of shells.

11. The portable communication device of claim 3, wherein the first shell is the innermost nested shell such that the enclosure encompasses a single substantially sealed space behind the second speaker side to form a sealed substantially sealed space defining an acoustic suspension enclosure.

12. The portable communication device of claim 3, wherein the enclosure when collapsed encompasses a space that is one-half or less than that space when the enclosure is expanded.

13. The portable communication device of claim 3, wherein the acoustic compliance of both the expanded and collapsed configurations are tuned to provide optimal output for loudspeaker operation in the expanded state and alert operation in the collapsed state.

14. The portable communication device of claim 3, wherein the acoustic compliance of the collapsed configuration is tuned to provide optimal output when coupled to a user's ear.

* * * * *